US008216695B2

(12) United States Patent
Nakanishi et al.

(10) Patent No.: US 8,216,695 B2
(45) Date of Patent: Jul. 10, 2012

(54) METHOD AND FACILITY FOR HOT DIP ZINC PLATING

(75) Inventors: Ryota Nakanishi, Kakogawa (JP); Hiroshi Irie, Kakogawa (JP); Masaya Nakamura, Kakogawa (JP); Kohei Okamoto, Kakogawa (JP); Masafumi Shimizu, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1114 days.

(21) Appl. No.: 11/722,410

(22) PCT Filed: Dec. 21, 2005

(86) PCT No.: PCT/JP2005/023467

§ 371 (c)(1),
(2), (4) Date: Jun. 21, 2007

(87) PCT Pub. No.: WO2006/068169

PCT Pub. Date: Jun. 29, 2006

(65) Prior Publication Data

US 2008/0023111 A1 Jan. 31, 2008

(30) Foreign Application Priority Data

Dec. 21, 2004 (JP) ..... 2004-369311
Mar. 31, 2005 (JP) ..... 2005-104151

(51) Int. Cl.
*B32B 15/00* (2006.01)
*C23C 8/10* (2006.01)

(52) U.S. Cl. ..... 428/659; 148/284; 118/47

(58) Field of Classification Search ..... 148/284; 118/47; 428/659
See application file for complete search history.

(56) References Cited

U.S. PATENT DOCUMENTS 4,133,634 A * 1/1979 Wang ..... 432/2

FOREIGN PATENT DOCUMENTS

| | | |
|---|---|---|
| EP | 0 523 809 A1 | 1/1993 |
| JP | 55 122865 | 9/1980 |
| JP | 4 202630 | 7/1992 |
| JP | 4 202631 | 7/1992 |
| JP | 4202632 | 7/1992 |
| JP | 4202633 | 7/1992 |
| JP | 4 254531 | 9/1992 |
| JP | 4 254532 | 9/1992 |

(Continued)

OTHER PUBLICATIONS

English abstract of JP 04202630.*

*Primary Examiner* — Emily Le
*Assistant Examiner* — Rebecca Lee
(74) *Attorney, Agent, or Firm* — Oblon, Spivak, McClelland, Maier & Neustadt, L.L.P.

(57) ABSTRACT

According to a process for hot-dip galvanization of the present invention, a steel sheet is treated by the oxidization/reduction method for better quality of galvanization and then hot-dip galvanized. An annealing line of equipment for hot-dip galvanization is composed of a non-oxidizing zone, an oxidizing zone, and a reducing zone, in his order. A steel sheet containing elements liable to oxidize more easily than iron is oxidized by blowing flames onto it in the oxidizing zone according to the oxidization/reduction method. Further, the steel sheet is reduced and annealed in the reducing zone.

5 Claims, 9 Drawing Sheets

FOREIGN PATENT DOCUMENTS

| | | | |
|---|---|---|---|
| JP | 5-70920 | | 3/1993 |
| JP | 6 88185 | | 3/1994 |
| JP | 6-88185 | | 3/1994 |
| JP | 6 306561 | | 11/1994 |
| JP | 7 34210 | | 2/1995 |
| JP | 7 90529 | | 4/1995 |
| JP | 2587725 | | 12/1996 |
| JP | 2587724 | * | 3/1997 |
| JP | 2003-342645 | | 12/2003 |

* cited by examiner

METHOD AND FACILITY FOR HOT DIP ZINC PLATING

TECHNICAL FIELD

The present invention relates to a process and equipment for hot-dip galvanization. The present invention relates especially to a process and equipment for oxidizing and reducing sheets of steel containing elements (for example, silicon and manganese) liable to oxidize more easily than iron for better quality of galvanization and then hot-dip galvanizing the steel sheets.

BACKGROUND ART

When a sheet of steel containing elements (metals) liable to oxidize more easily than iron is annealed in a annealing step (a reducing furnace) before galvanization, such elements may concentrate at the surfaces of the steel sheet to cause defective galvanization due to poor affinity with molten zinc later.

Known to cope with the above problem is a method of electroplating a steel sheet (basis sheer) with a ferrous metal before its hot-dip galvanization. This method is not practical, however, because electroplating apparatus has to be installed before hot-dip galvanizing equipment.

On the other hand, known is the oxidization/reduction method of heating, in advance, a steel sheet in an oxidizing gas to form ferrous oxide films on its surfaces and then reducing and hot-dip galvanizing the steel sheet (Patent documents 1 to 9).

For example, Patent document 1 discloses a version of the oxidization/reduction method of forming oxide films 400-10,000 Å thick on the surfaces of a steel sheet in a non-oxidizing furnace and then annealing the steel sheet in a reducing furnace. In the case of this version, however, the non-oxidizing furnace (NOF) is used as an oxidizing furnace and the effect is not stable.

Accordingly, disclosed in Patent documents 1 to 8, etc. are improved versions of the oxidization/reduction method. In these versions, methods of improving alloying characteristics are adopted. Namely, relatively thin oxide films are grown and reduced to form ferrous oxide films on the surfaces of a steel sheet for better alloying characteristics.

Disclosed in Patent document 9, for example, is a version of the oxidization/reduction method to stabilize the effect. In this case too, the concentrations of components of atmospheric gas are controlled to control the thickness of thin oxide films.

In many cases, the excess air ratio of burners and the concentrations of components of atmospheric gas are controlled in order to control the thickness of oxide films.

As for sheets of steel containing silicon, oxide films are grown on their surfaces and reduced to form ferrous layers by using the oxidization/reduction method for better galvanizing characteristics. As for sheets of steel of a high silicon content, iron will not oxidize easily and silicon will concentrate heavily in reduction. Accordingly, it is necessary to form thick oxide films in the step of oxidization of the oxidization/reduction method. This tendency and the necessity of thickening oxide films are salient in the case of steel containing silicon of 1.2 mass percent or more and more salient in the case of steel containing silicon of 1.8 mass percent or more. Besides this tendency and the necessity of thickening oxide films are salient, not only in the case of steel containing silicon but also in the case of steel containing elements which is liable to oxidize more easily than iron.

To increase the thickness of oxide films to be formed by the step of oxidization of the oxidization/reduction method, the line speed may be decreased to increase the time of oxidization in the oxidizing zone, which entails the increase of time of reduction. Thus, silicon concentrates heavily during the step of reduction disturbing the reduction of oxide films into proper ferrous layers.

To cope with the above problem, the reducing power of the reducing furnace is lowered to reduce thin oxide films appropriately. Lowering the reducing power requires the adjustment of concentrations of components of gas in the reducing furnace. The adjustment requires the replacement of reducing gas in the reducing furnace, which takes several tens of minutes. Therefore, lower in the reducing power of the reducing furnace is not practical for a galvanization line to galvanize various kinds of steel sheets.

If the oxidizing furnace is lengthened, the oxidizing time is elongated and thick oxide films can be formed without lowering the line speed. However, the galvanization line galvanizes sheets of steel containing no silicon, too. Besides, the balance of oxidization and reduction of the oxidization/reduction method is determined depending on the kinds of steel Therefore, if the oxidizing furnace is lengthened to oxidize sheets of steel containing silicon, its oxidizing power increases Accordingly, the oxidizing furnace has to be operated so that steel sheets will not oxidize easily, which lengthens the galvanizing line.

Patent document 1: Japanese Patent Laid-open No. 122865/1980

Patent document 2: Japanese Patent Laid-open No. 202360/1992

Patent document 3: Japanese Patent Laid-open No. 202361/1992

Patent document 4: Japanese Patent Laid-open No. 202362/1992

Patent document 5: Japanese Patent Laid-open No. 202363/1992

Patent document 6: Japanese Patent Laid-open No. 254531/1992

Patent document 7: Japanese Patent Laid-open No. 254532/1992

Patent document 8: Japanese Patent Laid-open No. 306561/1994

Patent document 9: Japanese Patent Laid-open No. 34210/1995

DISCLOSURE OF THE INVENTION

Problem to be Solved by the Invention

An object of the present invention is to provide a process and equipment for hot-dip galvanization. According to the process a sheet of steel containing elements liable to oxidize more easily than iron is oxidized and reduced by oxidization/reduction method and then galvanized. Thick oxide films can be formed on the surfaces of the steel sheet without lengthening the oxidizing furnace and reducing the line speed by oxidizing the surfaces of the steel sheet by the oxidization/reduction method. Further, in order to increase the growth rate and thickness of the oxide films, the present invention also proposes methods of controlling the thickness of oxide films by steel-sheet temperatures and by mixing oxygen and steam.

Another object of the present invention is to provide a process and equipment for hot-dip galvanization which are practical and relatively simple and do not require investment of a large sum of money unlike the pre-coated galvanization method of prior art. According to the process, the formation of oxide films of metals liable to oxidize easily, such as silicon, on the surfaces of steel sheets can be prevented effectively and galvanized steel sheets of stable quality and without defective galvanization can be produced.

Means for Solving the Problem

The first mode for carrying out the present invention is a process for hot-dip galvanization. According to the process, steel sheets are oxidized and reduced by the oxidization/reduction method for better quality of galvanization and then galvanized. Hot-dip galvanizing equipment has an annealing line comprising a non-oxidizing zone an oxidizing zone, and a reducing zone arranged in the order of description. Sheets of steel containing elements liable to oxidize more easily than iron are oxidized by flames blown to them in the oxidizing zone and then reduced and annealed in the reducing zone.

In the equipment, a steel sheet is heated and annealed, fed into the bath tub containing molten zinc, and the surfaces thereof is galvanized. The second invention is equipment for hot-dip galvanization. The hot-dip galvanizing equipment comprises a non-oxidizing furnace, an oxidizing furnace, a reducing/annealing furnace, and a hot-dip galvanizing apparatus arranged in the order of description. Steel sheets are oxidized in the oxidizing furnace by the oxidization/reduction method.

The third invention is another process for hot-dip galvanization. According to the process, sheets of steel containing elements liable to oxidize easily than iron are oxidized and reduced by the oxidization/reduction method for better quality of galvanization and then galvanized. Steel sheets are oxidized with flames blown to them by the oxidization/reduction method while the steel sheets go through the oxidizing zone of the flames. Oxide films are formed on the surfaces of the steel sheets at the rare of 200-2,000 Å/sec.

Effect of the Invention

An advantage offered by the present invention is as follows. When sheets of steel containing elements liable to oxidize easily than iron are oxidized and reduced by the oxidization/reduction method and then galvanized, thick oxide films can be formed without lengthening the oxidizing furnace and reducing the line speed by the oxidization/reduction method.

Another advantage offered by the present invention is as follows. According to the process and equipment for hot-dip galvanization which are practical and relatively simple and do not require investment of a large sum of money, the formation of oxide films of metals liable to oxidize easily, such as silicon, on the surfaces of steel sheets can be prevented effectively and galvanized steel sheets of stable quality and without defective galvanization can be produced.

DESCRIPTION OF REFERENCE NUMERALS

Figure 1:
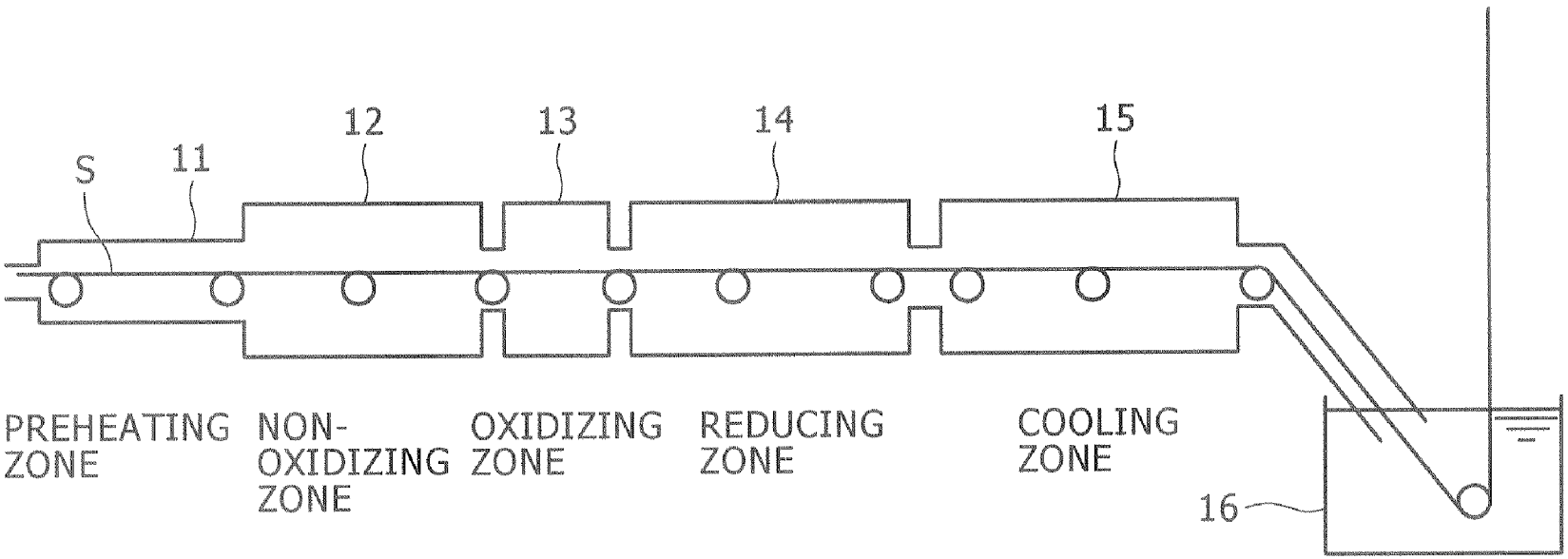
FIG. 1 is a schematic illustration of hot-dip galvanizing equipment of a first embodiment of the present invention. The hot-dip galvanizing equipment has an annealing line comprising a preheating zone, a non-oxidizing zone, an oxidizing zone, a reducing zone, and a cooling zone.

1 and 11: Preheater (Preheating zone)
2 and 13: Non-oxidizing furnace (Non-oxidizing zone)
3 and 13: Oxidizing furnace (Oxidizing zone)
4 and 14: Reducing furnace (Reducing zone)
5 and 15: Cooler (Cooling zone)
6 and 16: Hot-dip galvanizing apparatus
S: Steel sheet
P: Hot-dip galvanized steel sheet

BEST MODE FOR CARRYING OUT THE INVENTION

The inventors of the present invention (i) took notice of a process for forming ferrous oxide films on the uppermost surfaces of a steel sheet in a non-oxidizing furnace (sometimes referred to as an "NOF") prior to reducing and annealing in an annealing furnace in order to prevent silicon oxide films, a cause of defective galvanization, from being formed on the surfaces of the steel sheet and (ii) made a study of the process to arrive at the conclusion that it is difficult to make the process practicable because of the reason below.

Although it is possible to form ferrous oxide films on the uppermost surfaces of a steel sheet by adjusting the excess air ratio and heating the steel sheet in a non-oxidizing furnace, it is very difficult to form ferrous oxide films of uniform thickness because flames are blown on the steel sheet from both its sides in the non-oxidizing furnace to fail to achieve widthwise uniform temperature of the steel sheet. In the areas where the temperature of the steel sheet is low and, hence, ferrous oxide films are thin, the concentration of silicon at the surfaces of the steel sheet in the subsequent step of reduction cannot adequately be curbed and causes defective galvanization in the subsequent step of galvanization. In the areas where the temperature of the steel sheet is high and, hence, ferrous oxide films are too thick, part of the ferrous oxide films survive the subsequent reduction and cause defective galvanization in the step of galvanization and uneven alloying in the step of alloying after the galvanization.

The non-oxidizing furnace has another working of burning the rolling oil on the surfaces of a steel sheet to make them clean. However, the condition of oxidization of the surfaces of the steel sheet varies depending on the condition of rolling oil sticking onto the surfaces of the steel sheet.

Under the circumstances the inventors of the present invention abandoned the above idea of forming ferrous oxide films on the surfaces of a steel sheet in a non-oxidizing furnace and made further study to find a process for forming ferrous oxide films of even thickness on the entire surfaces of a steel sheet.

As a result of our further study, we found (i) that ferrous oxide films of even thickness can easily be formed on the surfaces of a steel sheet by putting, in addition to a non-oxidizing furnace, an exclusive oxidizing furnace between the non-oxidizing furnace and a reducing/annealing furnace and heating the steel sheet uniformly in the exclusive oxidizing furnace and (ii) that this process is the best solution to the problem of defective galvanization.

The following is the reason, in the present invention, why it is necessary to provide the above oxidizing furnace between the non-oxidizing furnace and the reducing furnace. Growing ferrous oxide films on the surfaces of a steel sheet requires raising the temperature of the steel sheet and blowing flames onto the surfaces of the steel sheet. If the above exclusive oxidizing furnace is put in front of an NOF, although ferrous oxide films are formed to some extent by flames blown onto the surfaces of the steel sheet, enough ferrous oxide films cannot be formed because the temperature of the steel sheet cannot be raised adequately. If the exclusive oxidizing furnace is put in the rear of the NOF, enough ferrous oxide films can be formed because the temperature of the steel sheet is raised in the NOF and then flames are blown onto the surfaces of the steel sheet.

First Embodiment

The process for hot-dip galvanization of the first embodiment of the present invention is as follows. A steel sheet containing elements oxidizing more easily than iron is treated by the oxidization/reduction method for better galvanization and then hot-dip galvanized. The oxidization of the oxidization/reduction method is made by blowing flames. The steel sheet goes through the oxidizing zone of blown flames in an oxidizing furnace to form oxide films at the rate of 200-2,000 Å/sec on the surfaces of the steel sheet.

Thus, when the oxidization according to the oxidization/reduction method is made by blowing flames and allowing the steel sheet to go through the oxidizing zone of blown flames, relatively thick oxide films can be formed at a relatively high rate in other words, relatively thick oxide films can be formed without reducing the speed of the galvanization line and lengthening the oxidizing furnace. In this regard, it becomes possible to form oxide films at the rate of 200-2,000 Å/sec, thereby relatively thick oxide films can be formed.

Therefore, according to the process for hot-dip galvanization of the first embodiment of the present invention, when a steel sheet containing elements which are liable to oxidize more easily than iron is oxidized and reduced by the oxidization reduction method and galvanized, thick oxide films on the surfaces thereof can be formed in the step of oxidization by the oxidization/reduction method without reducing the speed of the galvanization line and lengthening the oxidizing furnace.

The above rate of formation of oxide films of 200-2,000 Å/sec by the oxidization/reduction method is much higher than that (for example, 30-50 Å/sec) of prior art. According to the process for hot-dip galvanization of the first embodiment of the present invention, oxide films are rapidly formed, in the oxidizing zone by the oxidization/reduction method on the surfaces of a steel sheet. The formation rate means the rate of increase of thickness of oxide films. For example, if the formation rate is 2,000 Å/sec, the thickness of oxide films increases at the rate of 2,000 Å/sec (second). Because the rate is not constant while an oxide film is formed due to changing temperature of the steel sheet and the changing positions of blown flames, the average rate during the rapid formation of an oxide film is adopted.

According to the process for hot-dip galvanization of the first embodiment of the present invention, as described above, oxide films are rapidly formed, in the oxidizing zone by the oxidization/reduction method on the surfaces of a steel sheet at the rate of 200-2,000 Å/sec. Therefore, thick oxide films can be formed while the galvanization line is running for achieving a certain time for oxidization.

The rate of formation of oxide films, on the surfaces of the steel sheet, of 200-2,000 Å/sec is chosen because if the formation rate is lower than 200 Å/sec, oxide films of enough thickness cannot be formed and if the rate is higher than 2,000 Å/sec, it is difficult to control thickness of the oxide films, which results in reduced precision of thickness of oxide films. If oxide films are too thick, they may partly survive the reduction in the reducing furnace.

The formation rate of oxide films of 200-2,000 Å/sec can be secured by heating a steel sheet up to 600° C. and then flames are blown onto the surfaces of the steel sheet, resulting in sufficiently thick oxide films.

If burners are used to blow flames and oxygen equivalent to 0-20 volume percent of combustion air and/or steam equivalent to 0-40 volume percent of combustion air are/is mixed into the combustion air, oxide films can be formed at a high level in the range of 200-2,000 Å/sec and, hence, oxide films of enough thickness can easily be formed.

Figure 5:
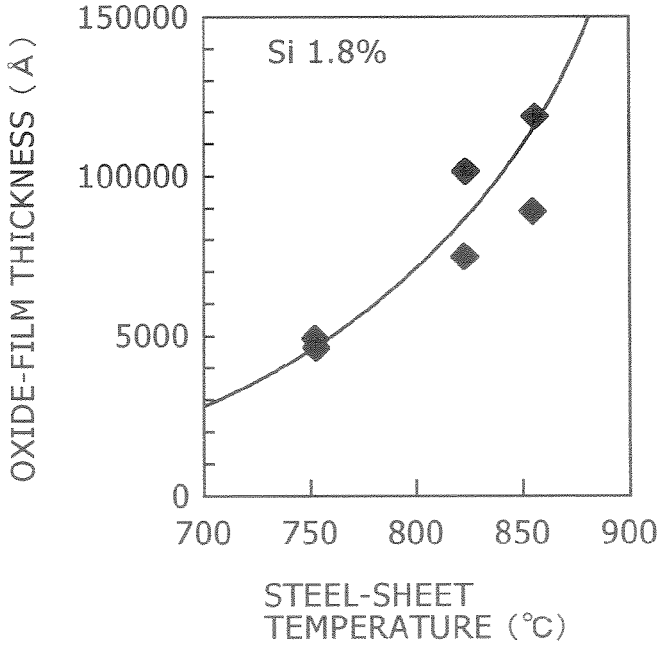
FIG. 5 shows the relationship between the temperature of steel sheets and the thickness of oxide films.

FIG. 5 shows the relationship between the temperature of steel sheets and the thickness of oxide films. It shows that the higher the temperature is, the thicker the oxides films are Thus, keeping a steel sheet at a high temperature is important to the quick growth of its oxide films. Thus, it is desirable to keep the steel sheet at a high temperature from the viewpoint of the quick growth of the oxide films. In an actual galvanization line, however, the temperature of a steel sheet must be below 850° C. so that it will not lose its strength to withstand the tension working on it.

Figure 6:
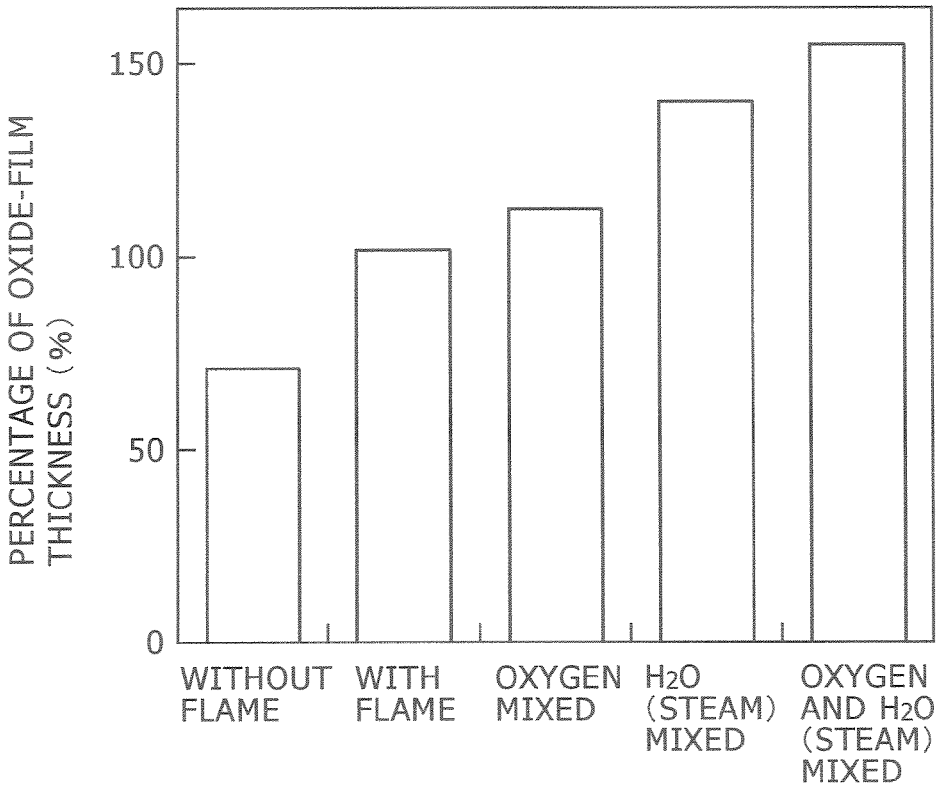
FIG. 6 shows the thicknesses of oxide films in the cases of (i) without blown flames, (ii) with blown flames, (iii) oxygen mixed into air in burners, (iv) $H_2O$ (steam) mixed into air in burners, and (v) both oxygen and $H_2O$ (steam) mixed into air in burners.

FIG. 6 shows the thicknesses of oxide films in the cases of (i) without blown flames, (ii) with blown flames, (iii) oxygen mixed into combustion air in burners when flames are blown by the burners, (iv) steam mixed into combustion air in burners when flames are blown by the burners, and (v) both oxygen and steam mixed into combustion air in burners when flames are blown by the burners. Further, in FIG. 6, the thickness of the oxide film when flames are blown is indicated as 100%. The greater the ratio is, the quicker the oxide films grow. Contrary to the case without blown flames, blowing flames on a steel sheet accelerates the formation of oxide films. Mixing oxygen into air accelerates the formation of oxide films further. Mixing steam into air accelerates the formation of oxide films still further. Mixing both oxygen and steam into air accelerates the formation of oxide films yet further.

Figure 7:
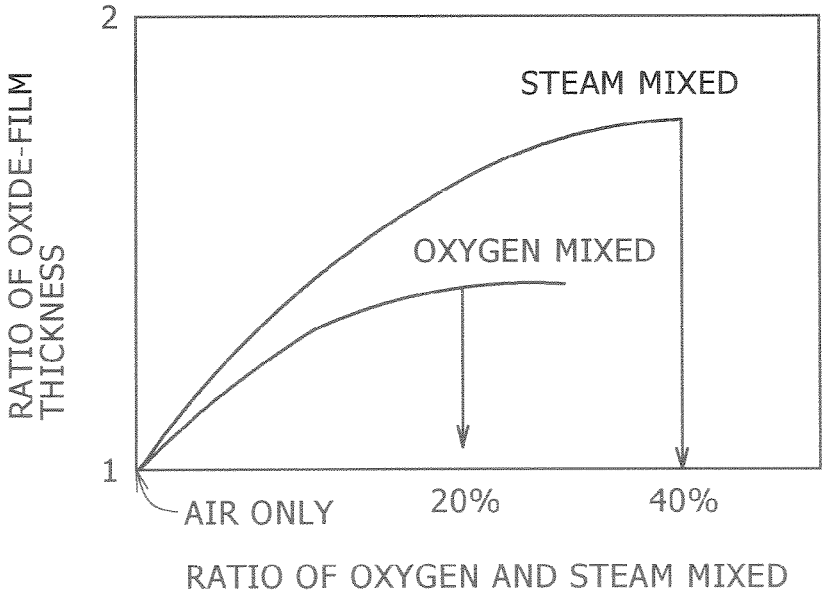
FIG. 7 shows the relationship between the ratios of oxygen and steam mixed into air to air and the thicknesses of oxide films.

FIG. 7 shows the relationship between the ratios of oxygen and steam mixed into air to air and the thicknesses of oxide films. The greater the ratio is, the quicker the oxide films grow. As shown in FIG. 7, adding oxygen (mixing oxygen) and steam into air accelerates the formation of oxide films, but the degrees of oxidization reach a plateau at certain ratios of oxygen and steam to air. Therefore since mixing oxygen and steam requires a utility cost, it is economical to mix oxygen and steam into air at ratios smaller than those where the degrees of oxidization reach a plateau.

Accordingly, it is desirable to mix oxygen into combustion air of burners at a ratio (quantity of flow) of 0-20 volume percent, especially at a ratio of 5-10 volume percent, and steam into air at a ratio of 0-40 volume percent, as described above. On the other hand, if oxygen alone is mixed into air, the temperature of flames may rise and flames may shorten. Since the amount of heat transferred to the sheet changes, the temperature of a steel sheet may change and the formation rate of oxide films may change. If steam alone is mixed into air, the temperature of flames lowers, lowering the temperature of a steel sheet. Accordingly, the increase of the formation rate of oxide films due to the steam mixed into air may be offset by the decrease of the formation rate of oxide films due to the lowered temperature of the steel sheet. If both oxygen and steam are mixed into air at their respective certain ratios to air, oxide films can be formed under the constant temperature and length of flames and, hence, the constant temperature of the steel sheet. As a result, the formation rate of oxide films increases generally constantly as the oxygen and steam are mixed so that the control of the thickness of the oxide films can be controlled easily. Therefore, with a certain amount of oxygen and steam mixed and with setting the sheet temperature for securing a certain oxide-film thickness, the formation rate of oxide films can be controlled by changing the ratios of oxygen and steam to air.

Figure 8:
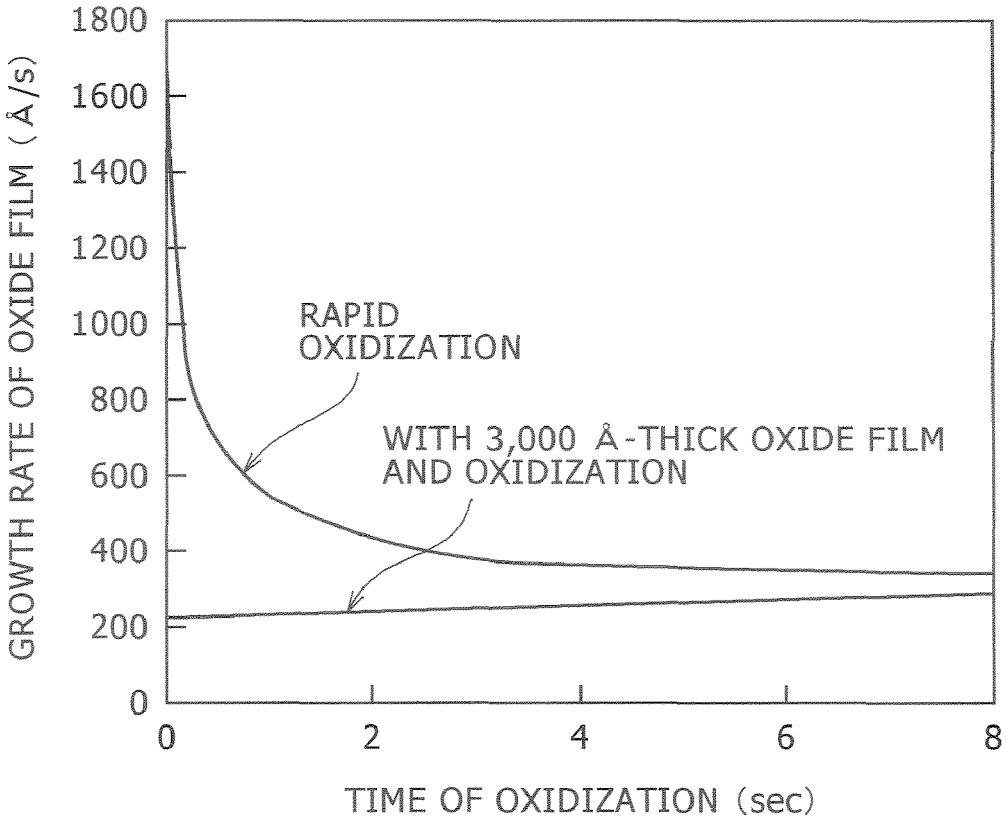
FIG. 8 shows the time of oxidization and the growth rate of oxide films.

FIG. 8 shows the growth rates of oxide films in a case where a steel sheet without oxide films is rapidly oxidized and in another case where a steel sheet with oxide films of the thickness of 3,000 Å rapidly oxidized. It is shown that the thicker the oxide films are, the smaller the growth rate of oxide films is.

The high temperature of a steel sheet in an oxidizing zone means a high growth rate of oxide films on the steel sheet. Therefore, if the annealing line of hot-dip galvanizing equipment is composed of a non-oxidizing or reducing zone, an oxidizing zone, and a reducing zone, in this order, and a steel sheet is oxidized by the oxidization/reduction method in the oxidizing zone, oxide films can be formed on the surfaces of the steel sheet as rapidly as 200-2,000 Å/sec. Also, such a rapid growth can easily be made and it is easier to raise the growth rate of the oxide films. If the temperature of a steel sheet is raised as high as possible in the non-oxidizing zone or reducing zone in a state without oxygen and then it is rapidly oxidized in the oxidizing zone, a high rate of formation of oxide films can easily be achieved.

If a non-oxidizing zone is used as an oxidizing zones oxide films are gradually formed and the diffusion of oxygen is disturbed. Therefore if a steel sheet is not oxidized at a low temperature and oxidized rapidly a at high temperature, a high rate of formation of oxide films on the steel sheet can be achieved. In addition, mixing oxygen and steam into combustion air in burners raises the formation rate of oxide films as described above.

If oxygen and steam are mixed into combustion air in burners, the rate of formation of oxide films can be controlled by changing the ratios of oxygen and steam to air while the combustion rate of burners is kept constant.

The hot-dip galvanizing equipment of the first embodiment of the present invention comprises an annealing line and a hot-dip galvanizing apparatus. The annealing line includes a non-oxidizing zone, a reducing zone, an oxidizing zone, and a reducing zone, in this order. Steel sheets are oxidized in the oxidizing zone by the oxidization/reduction method. The first zone may be a reducing zone instead of a non-oxidizing zone. With this hot-dip galvanizing equipment, the process for hot-dip galvanization of the first embodiment of the present invention described earlier can be executed reliably.

If steel sheets are oxidized with a plurality of burners blowing flames onto their surfaces in accordance with the oxidization/reduction method in the first embodiment of the present inventions the width of blown flames can be adjusted by changing the number of live burners. Thus, the time of blowing flames can be adjusted and, thereby the rate of formation of oxide films can be controlled. If the combustion rate of burners goes down, their flames shorten, failing to reach the surfaces of a steel sheet and reducing rapidly the rate of formation of oxide films on the surfaces of the steel sheet. If a plurality of burners are arranged so that flames will be blown onto the surfaces of a steel sheet without fail when the combustion rate of burners goes down, oxide films can be formed stably on the surfaces of the steel sheet. In this regard, if the combustion rate of burners is allowed to go down to a level where the effect of blown flames is not still reduced and to get smaller than the set value, it becomes possible to sequentially form oxide films by a method of turning off some of the plurality of burners.

As described above, when a steel sheet is oxidized by the oxidization/reduction method, the temperature of the steel sheet has an effect on the thickness of oxide films to be formed on the steel sheet (see FIG. 5). Accordingly, the thickness of oxide films can be controlled by controlling the temperature of the steel sheet. This control of the temperature of steel sheets can be achieved in the hot-dip galvanizing equipment, comprising the non-oxidizing zone or reducing zone, oxidizing zone, and reducing zone, of the present invention as follows.

The temperature of a steel sheet can be controlled by controlling the combustion rate of burners at the furnace temperature in the oxidizing zone. If the combustion rate of burners is reduced, the flames of burners are shorten and weaken, the temperature of the steel sheet is reduced very much and an effect of the above rate of formation of oxide films on the steel sheet is increased. For alleviating the above effect and for a better control of the temperature of steel sheets in the oxidizing zone, following method may be employed. The temperature of a steel sheet in the oxidizing zone may be controlled by controlling the heating power of the non-oxidizing zone before the oxidizing zone by keeping the combustion rate of the burners in the oxidizing zone constants, or by making use of the furnace temperature of the non-oxidizing or reducing zone before the oxidizing zone. The temperature of a steel sheet in the oxidizing zone may be controlled by controlling the heating power of the zone before the oxidizing zone (non-oxidizing zone) by making use of the temperature of the steel sheet at the exit of the oxidizing zone or at the entrance to the zone after the oxidizing zone (reducing zone). These methods of controlling the temperature of steel sheets may be combined.

According to the oxidization/reduction method of prior art, a non-oxidizing zone is merely used as an oxidizing zone and the rate of formation of oxide films is controlled by controlling the excess air ratio. On the other hand, the combustion rate is controlled to fulfill the conditions for annealing and has noting to do with the control the temperature of a steel sheet being oxidized. The thickness of oxide films is controlled by controlling the excess air ratio. However, when the excess air ratio is changed, the condition of flames changes very much. Thus, the effect is not stable. On the other hand, according to the present invention, an oxidizing zone is provided after a non-oxidizing zone. The rate of formation of oxide films is controlled by controlling the temperature of the steel sheet at the entrance to the oxidizing zone by controlling the combustion rate of the preceding zone, in an almost constant combustion rate of the burners. This controlling method proved capable of forming oxide films of certain thickness stably.

Steel contains various elements for various purposes. Some of them are liable to oxidize more easily than iron, and the present invention is directed to such steel. An example of such steel contains silicon of 0.2% or more, manganese of 1.0% or more, and aluminium of 0.1% or more. The present invention is directed especially to steel containing silicon of 0.2-3.0 weight %, especially 0.5-3.0 weight %.

One may consider to lengthen the oxidizing furnace to elongate the time of oxidation and, thereby, increase the thickness of oxide films on a steel sheet. Due to restriction on equipment, however, the oxidizing furnace cannot be lengthened very much. Even if there is no restriction on equipment and the oxidizing furnace can be lengthened enough, it is necessary to reduce the oxidizing power of the oxidizing furnace in order to oxidize steel sheets liable to be oxidized easily, which enlarges the equipment. On the other hand, according to the present invention, thick oxide films can be formed without lengthening the oxidizing furnace and reducing the line speed because oxide films are formed rapidly.

FIG. 1 shows, for forming oxide films rapidly during the oxidization by the oxidization/reduction method, a hot-dip galvanizing equipment in accordance with the present invention. The hot-dip galvanizing equipment comprises an annealing line and a hot-dip galvanizing apparatus 16 behind it. The annealing line of a steel sheet "S" includes a preheating zone (a preheater) 11, a non-oxidizing zone (a non-oxidizing furnace) 12, an oxidizing zone (an oxidizing furnace) 13, a reducing zone (a reducing furnace) 14, and a cooling zone (a cooler) 15 arranged in the order of description. Thus, the oxidizing zone 13 is provided after the non-oxidizing zone 12.

Figure 2:
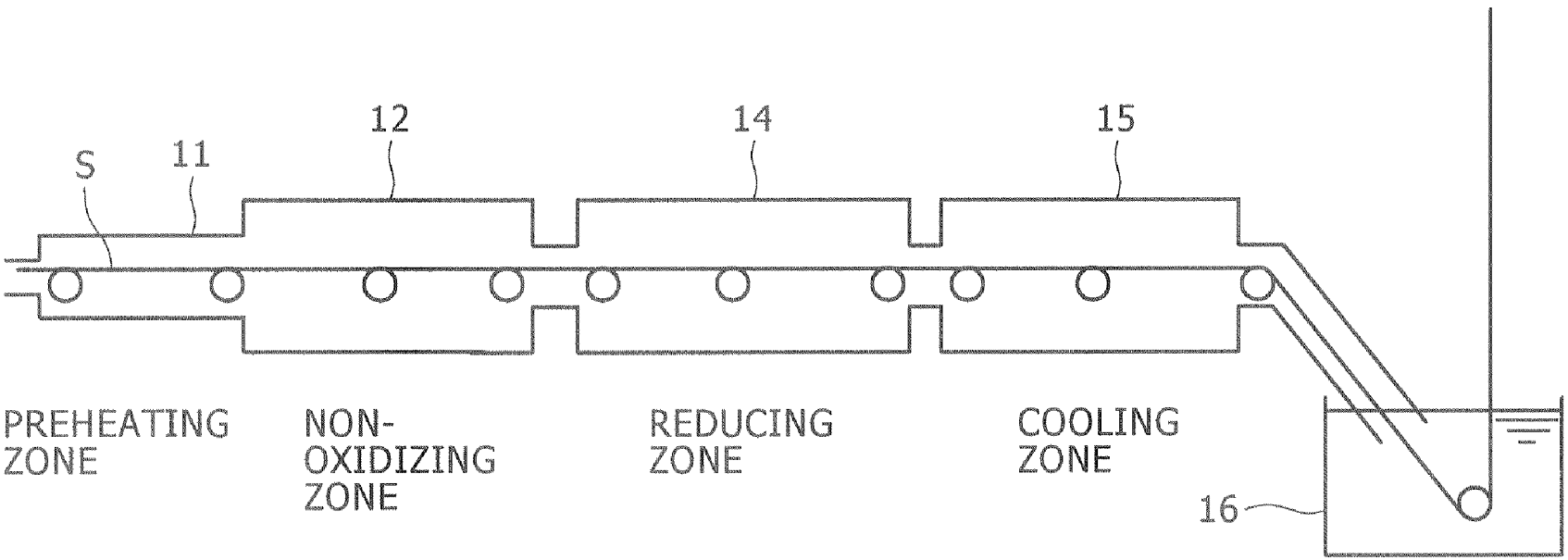
FIG. 2 is a schematic illustration of hot-dip galvanizing equipment of prior art having a horizontal annealing line.

FIG. 2 shows a hot-dip galvanizing equipment which has no oxidizing zone.

Figure 4:
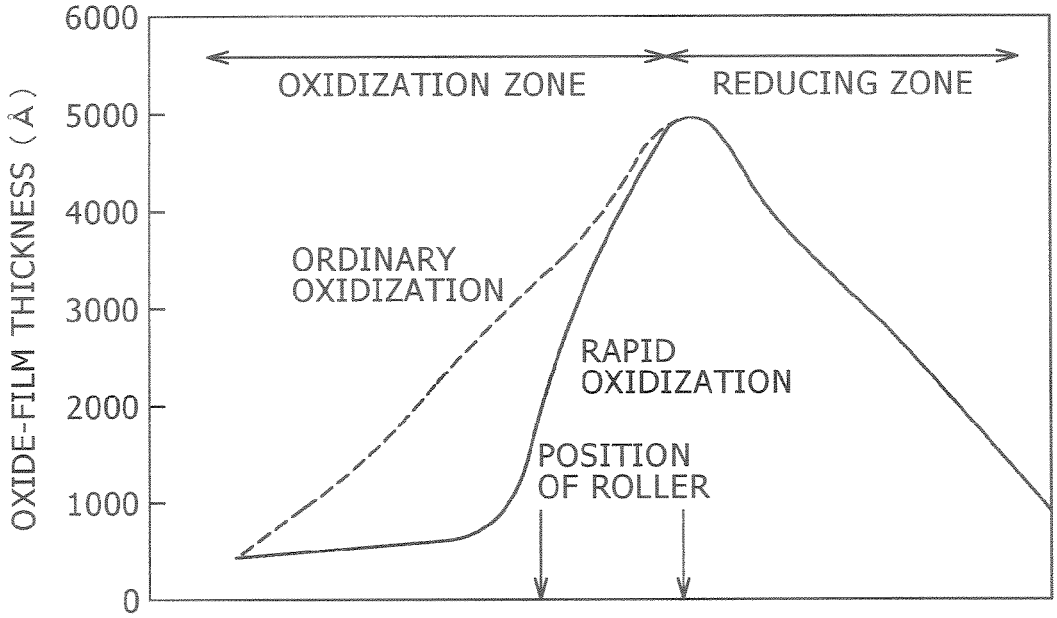
FIG. 4 shows the distribution of thickness of oxide films in the longitudinal direction of the furnace in the cases of ordinary oxidization and rapid oxidization.

FIG. 4 shows (i) the distribution of thickness of oxide films in the longitudinal direction of the furnace in the case where a steel sheet is oxidized in the non-oxidizing zone, which is used as an oxidizing zone, of the hot-dip galvanizing equipment of FIG. 2 ("ordinary oxidization") and (ii) the distribution of thickness of oxide films in the longitudinal direction of the furnace in the case where a steel sheet is oxidized in the oxidizing zone 13 of the hot-dip galvanizing equipment of FIG. 1 ("rapid oxidization"). In FIG. 4, steel sheets run from the left to the right. Of the two arrows indicating the positions of rollers, the right arrow indicates the position of a roller disposed in the furnace.

As shown in FIG. 4, in the case of oxidation by using the non-oxidizing furnace 12 as an oxidizing zone (ordinary oxidization), oxide films are gradually formed. Therefore, oxide films come in contact with the roller disposed in the furnace while the oxide films are becoming thicker and when they have become thicker. On the other hands in the case of rapid oxidization by using the oxidizing zone 13 (rapid oxidization), because the rate of oxidization is high, oxide films can be formed without touching the roller in the furnace. Accordingly, the formed oxide films do not peel easily in the latter case. Namely, in the latter case, the temperature of a steel sheet is raised in the non-oxidizing furnace 12 (the steel sheet is not oxidized or is hardly oxidized) in a non-oxidized state and then the steel sheet is oxidized rapidly in the oxidizing zone, oxide films formed rapidly. Because the oxide films become thicker rapidly, the steel sheet may come in contact with the roller disposed in front (to the left) of the middle roller in the furnace before the formation of oxide films or in the early stage of formation of oxide films (oxide films are very thin) but the steel sheet comes in a little contact with the roller while oxide films are becoming thicker or when they have become thicker in the oxidizing zone 13. Therefore, the formed oxide films do not peel easily. On the other hand, because there is a roller at the entrance to the reducing furnace 14 and the steel sheet comes in contact with the roller, its oxide films may peel. Anyway, in the latter case (shown in FIG. 1), oxide films can be made thick by rapid oxidization and come in less contact with rollers. Accordingly, formed oxide films peel less frequently and are dented less frequently by oxide-film fragments sticking on rollers.

Figure 3:
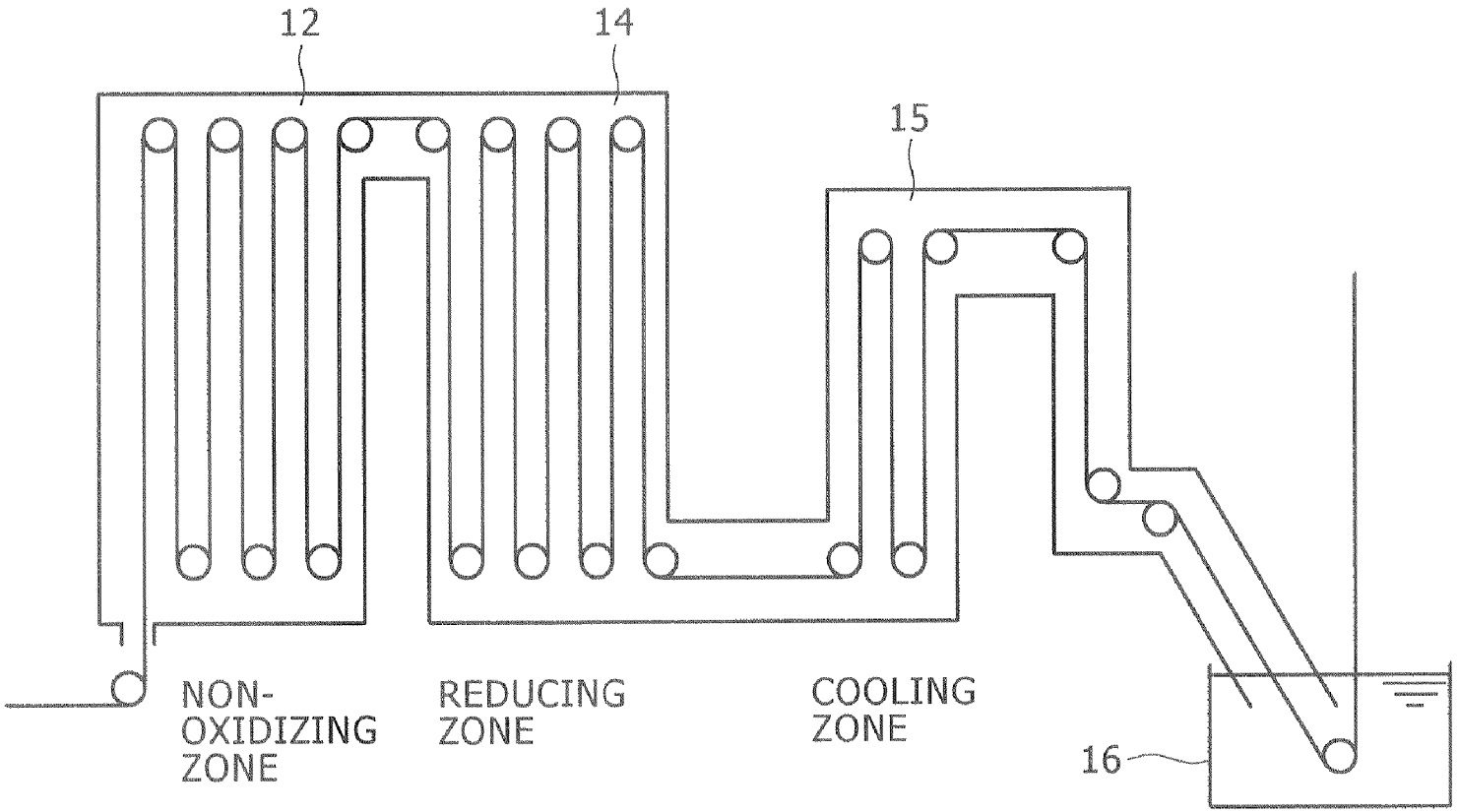
FIG. 3 is a schematic illustration of hot-dip galvanizing equipment of prior art having a vertical annealing line.

FIG. 2 shows equipment of a horizontal line; FIG. 3, a vertical line. In the case of the vertical line of FIG. 3, the curvature at rollers is large. Therefore, the oxide films would be liable to peel more easily than oxide films in the horizontal line shown in FIG. 2.

As described above, iron in a steel sheet of steel of a high silicon content does not oxidize easily in an oxidizing zone and silicon in the steel sheet concentrates heavily in a reducing zone; therefore, it is necessary to form thick oxide films in the step of oxidation by the oxidization/reduction method. This tendency and the necessity of thickening oxide films are salient in the case of steel containing silicon of 1.2 mass percent or more and more salient in the case of steel containing silicon of 1.8 mass percent or more. According to the process for hot-dip galvanization of the first embodiment of the present invention, thick oxide films can be formed without lengthening the oxidizing furnace 13 and reducing the line speed by the oxidization/reduction method as described above. Therefore, the process for hot-dip galvanization of the first embodiment of the present invention is effective when it is applied to steel sheets of steel containing silicon of 1.2 mass percent or more and more effective when it is applied to steel sheets of steel containing silicon of 1.8 mass percent or more.

Second Embodiment

Figure 9:
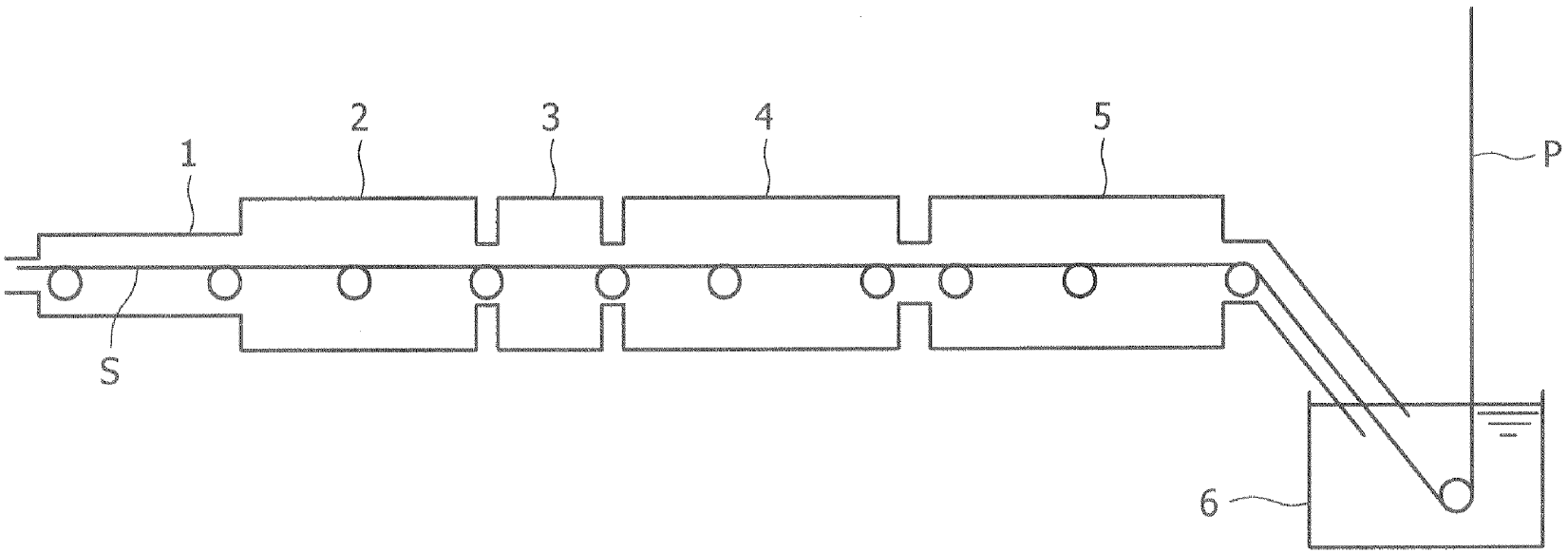
FIG. 9 is an illustration of equipment for hot-dip galvanization according to a second embodiment of the present invention.

FIG. 9 is an illustration of equipment for hot-dip galvanization according to the present invention. A steel sheet "S" after steps of rolling etc. is run through the hot-dip galvanizing equipment to be a galvanized steel sheet "P." The hot-dip galvanizing equipment comprises a preheater 1, a non-oxidizing furnace 2, an oxidizing furnace 3, a reducing/annealing furnace 4, a cooler 5, and a hot-dip galvanizing apparatus 6 arrange in this order from the entrance side of the steel sheet "S" to the exit side of the hot-dip galvanized steel sheet "P." Since the oxidizing furnace 3 is disposed between the non-oxidizing furnace 2 and the reducing/annealing furnace 4, the steel sheet "S" is heated up by the preheater 1 and the non-oxidizing furnace 2; therefore, as in FIG. 9, the small oxidizing furnace 3 will do.

It is necessary to prevent the steel sheet "S" from oxidizing in the non-oxidizing furnace 2 disposed before the oxidizing furnace 3. If oxide films are formed on the surfaces of the steel sheet "S" in the non-oxidizing furnace 2, the thickness of the oxide films is uneven, as described above. Then, the steel sheet "S" is oxidized in the oxidizing furnace 3 to grow the oxide films. However, the unevenness caused in the non-oxidizing furnace 3 survives, which results in uneven galvanization.

In order to solve the above problem, according to the present invention, the excess air ratio $r_1$ must be below 1.0 in the non-oxidizing furnace 3. If the excess air ratio $r_1$ is over 1.0, oxide films are formed rapidly on the surfaces of the steel sheet "S".

If the excess air ratio $r_1$ is below 1.0, oxide films become thicker as the temperature that the steel sheet reaches, namely, the reached temperature t of the steel sheet "S" increases and the oxide films become thicker accordingly. Therefore, in the second embodiment of the present invention, the relationship of the excess air ratio $r_1$ and the reached temperature t (° C.) of the steel sheet has to satisfy the expression (1) below.

$$t \leqq -1{,}000 \times r_1 + 1750 \quad (1)$$

On the other hand, it is necessary to burn and remove adequately the rolling oil sticking onto the steel sheet "S" in the non-oxidizing furnace 2. If some of the rolling oil survives the incineration, it is burned in the oxidizing furnace 3. However, the formation of oxide films of uniform thickness in the oxidizing furnace 3 is disturbed depending on the original condition of rolling oil sticking on the surfaces of the steel sheet and the uneven incineration of rolling oil in the non-oxidizing furnace 2. According to the present invention, excess air ratio $r_1$ must be 0.9 or higher and the reached temperature t of the steel sheet must be 450° C. or higher in order to burn and remove the rolling oil adequately.

As a heating condition of a steel sheet in the oxidizing furnace 3 according to the second embodiment of the present invention, the air-fuel ratio $r_2$ of burners must be 1.00 or higher for efficient oxidization of the surfaces of the steel sheet, and it is desirable for the air-fuel ratio $r_2$ to be between 1.00 and 1.25. If the air-fuel ratio $r_2$ goes beyond 1.25, oxidization reaches a plateau and heating efficiency goes down.

During the heating with burners in the oxidizing furnace 3, it is desirable that the nozzles of burners be directed toward the upper and lower surfaces of the steel sheet "S" to apply flames directly to the surfaces for direct heating. Burners are necessary for efficient formation of oxide films. Applying flames onto the surfaces of a steel sheet uniformly in the lateral direction of the steel sheet may be achieved by arranging many burners in the lateral direction of the steel sheet. Adoption, especially, of a slit burner is desirable, which is effective in space saving, too.

Several pairs of slit burners, instead a single pair in the moving direction of the steel sheet, may be arranged in stages for more efficient oxidization.

Figure 10:
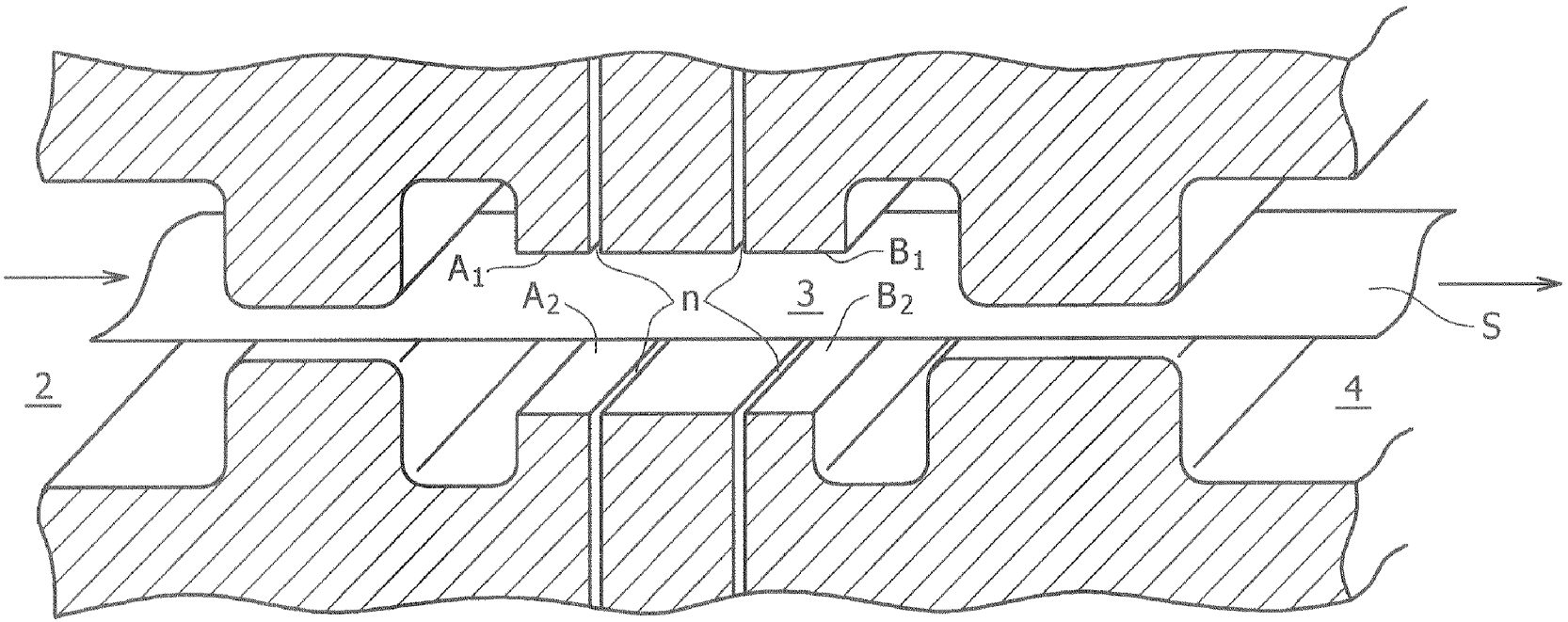
FIG. 10 is a sectional schematic illustration of the arrangement of slit burners provided in the oxidizing furnace of the hot-dip galvanizing equipment according to the second embodiment of the present invention.
Figure 11:
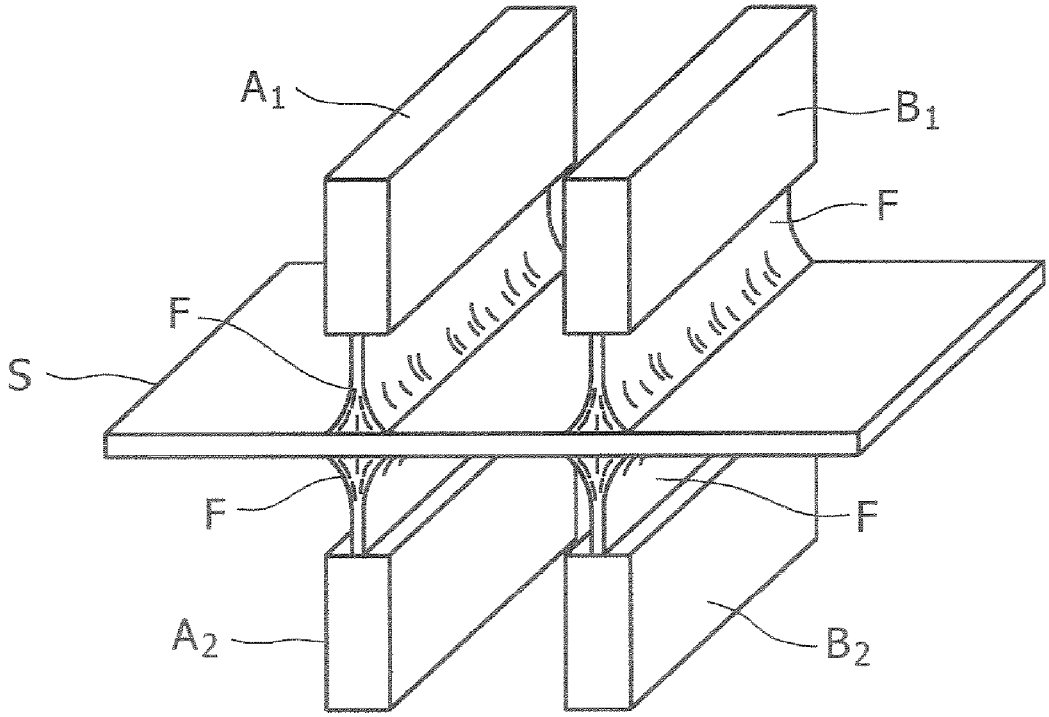
FIG. 11 is an illustration of the actual heating up of a steel sheet by the slit burners.

FIG. 10 is a sectional schematic illustration of slit burners disposed in an oxidizing furnace. It shows the two-stage arrangement of a pair of slit burners $A_1$ and $A_2$ and another pair of slit burners $B_1$ and $B_2$ in the upper and lower portions, respectively, in the oxidizing furnace 3, each pair of burners being next to each other in the moving direction of the steel sheet "S," sandwiching the steel sheet "S." Each of the slit burners $A_1$, $A_2$, $B_1$, and $B_2$ has a slit nozzle "n" extending in the lateral direction of the steel sheet "S." The slit nozzles "n" are perpendicular to the upper and lower surfaces of the steel sheet "S." FIG. 11 is the illustration of the heating up of a steel sheet by the slit burners in two stages. The slit burners blow flames F in the shape of a curtain, in the lateral direction of the steel sheet "S," directly onto the upper and lower surfaces of the steel sheet "S."

With use of such slit burners under the above heating condition, the steel sheet "S" whose oil is burned and removed under the heating condition which is already heated to 450-850° C. in the non-oxidizing furnace 2 can be heated to a target steel-sheet temperature rapidly, uniformly in a short time (5-20 seconds) in the oxidizing furnace 3. Thus, formed on the steel sheet in the oxidizing furnace are ferrous oxide films whose thickness is uniform in the lateral direction of the steel sheet and the steel sheet is supplied to the next reducing/annealing furnace 4.

The thickness of the ferrous oxide films thus formed in the oxidizing furnace 3 varies depending on the amount of silicon contained in the steel sheet "S" and the thickness thereof. However, it is preferable for the thickness of oxide films to be 3,000-10,000 Å. If the oxide films are thinner than 3000 Å, they may fail to function adequately as a barrier for the prevention of silicon from diffusing to and concentrating at the surfaces of the steel sheet "S." If the oxide films are thicker than 10,000 Å, they are overdone as such a barrier and the heating time in the oxidizing furnace lengthens and more fuel is consumed.

The thickness of the ferrous oxide films can be estimated relatively easily by monitoring the temperature of the steel sheet at the entrance to the oxidizing furnace 3 and correcting the monitored temperature with the kind of steel, the thickness of the steel sheet, the line speed, the excess air ratio in the oxidizing furnace, and the output (total quantities of fed fuel and air) of the oxidizing furnace. Stable oxidization can be maintained by adjusting the output of the oxidizing furnace 3 based on the estimated value, which results in stable galvanization in the longitudinal direction of the steel sheet.

The second embodiment of the present invention is directed to the same kinds of steel sheets as the first embodiment. Namely, the hot-dip galvanizing equipment of the second embodiment is effective in galvanizing sheets of steel containing manly elements which are liable to oxidize more easily than iron. An example of such steel contains silicon of 0.2% or higher and/or manganese of 1.0% or higher and/or aluminium of 0.1% or higher. The hot-dip galvanizing equipment is especially effective in galvanizing sheets of steel containing silicon of 0.2-3.0 weight percent, especially 0.5-3.0 weight percent.

FIRST WORKING EXAMPLES

The first working examples of the present invention correspond mainly to the first embodiment.

Example 1

Example 1 is a hot-dip galvanizing equipment comprising (i) an annealing line including a preheating chamber, a non-oxidizing zone, an oxidizing zone, and a reducing zone arranged in the order of description, (ii) a hot-dip galvanizing apparatus having a bath tub containing molten zinc and a means of wiping with air, and (iii) rollers to feed steel sheets. The hot-dip galvanizing equipment is of a horizontal type. Steel sheets are galvanized as follows.

A sheet of high-tensile-strength steel containing carbon of 0.1 mass percents silicon of 1.8 mass percent, manganese of 1.5 mass percents and iron and unavoidable impurities of the remaining mass percent is heated to 400° C. in the preheating chamber and further heated to 700° C. in the non-oxidizing furnace. Then, the steel sheet is heated to 850° C. with burners blowing flames onto it in the oxidizing furnace. The excess air ratio of burners is 1.2. Thus, oxide films are grown and formed on the surfaces of the steel sheet. The rate of formation of oxide films is 560 Å/sec and the thickness of oxide films formed is 5,600 Å.

Next, the steel sheet on which the oxide films are formed is fed into the reducing furnace containing air which contains hydrogen of 15 volume percent, wherein the oxide films are reduced. Then, the steel sheet is fed into the bath tub containing molten zinc to be galvanized. The coating weight is adjusted to 50 g/m$^2$ by the means of wiping with air. Also, the temperature of the steel sheet fed into the reducing furnace is 850° C. and the temperature inside the reducing furnace is 900° C.

As described above, the rate of formation of oxide films can be raised by heating the steel sheet to a high temperature in a non-oxidizing furnace and heating the steel sheet further to a higher temperature with burners in an oxidizing furnace.

Example 2

When blowing flames onto a steel sheet with burners in the oxidizing furnace, steam equivalent to 10 volume percent of combustion air was mixed into the combustion air of the burners. Except for this, by the same process as in Example 1, a hot-dip galvanized steel sheet was obtained (No. 2) The rate of formation of oxide films by oxidization in the oxidizing furnace is 770 Å/sec and the thickness of the oxide films formed by the oxidization is 7,700 Å.

Example 3

When blowing flames onto a steel sheet with burners in the oxidizing furnace, oxygen equivalent to 5 volume percent of combustion air was mixed into the combustion air of the burners. Except for this, by the same process as in Example a, a hot-dip galvanized steel sheet was obtained (No. 3) The rate of formation of oxide films by oxidization in the oxidizing furnace is 620 Å/sec, and the thickness of the oxide films formed by the oxidization is 6,200 Å.

Example 4

When blowing flames onto a steel sheet with burners in the oxidizing furnace, oxygen equivalent to 5 volume percent of combustion air was mixed into the combustion air of the burners and steam equivalent to 10 volume percent was mixed as well. Except for this, by the same process as in Example 1, a hot-dip galvanized steel sheet was obtained (No. 4). The rate of formation of oxide films by oxidization in the oxidizing furnace is 850 Å/sec and the thickness of the oxide films formed by the oxidization is 8,500 Å.

Example 5

The steel sheet was heated to 600° C. in the non-oxidizing furnace and was heated to 750° C. in the oxidizing furnace. When blowing flames onto the steel sheet with burners in the oxidizing furnace, oxygen equivalent to 5 volume percent of combustion air was mixed into the combustion air of the burners and steam equivalent to 10 volume percent was mixed as well. Except for this, by the same process as in Example 1, a galvanized steel sheet was obtained (No. 5) The rate of formation of oxide films by oxidization in the oxidizing furnace is 180 Å/sec and the thickness of the oxide films formed by the oxidization is 1,800 Å. Further, the temperature of the steel sheet fed into the reducing furnace is 750° C. The temperature inside the reducing furnace is 800° C. (which differs from the case of Example 1).

Example 6

The same kind of steel sheet as in Example 1 is preheated to 400° C. in a preheating chamber and then heated to 700° C. in the non-oxidizing furnace. After this, the steel sheet is heated to 850° C. not by using burners to blow flames onto it in the oxidizing furnace but by oxidization in an atmospheric gas. With this, oxide films are grown and formed on the surfaces of the steel sheet. The rate of formation of oxide films is 50 Å/sec and the thickness of the oxide films thus formed is 500 Å.

After the formation of the oxide films, by the same process as in Example 1, reduction, hot-dip galvanization, and adjustment of coating weight by air wiping are performed to obtain a hot-dip galvanized steel sheet (No. 6).

Example 7

The same kind of steel sheet as in Example 1 is preheated to 400° C. in the preheating chamber. Then the non-oxidizing furnace is used as an oxidizing furnace to heat the steel sheet to 700° C. Further, the excess air ratio of burners in the non-oxidizing furnace is 1.2. As a result, when heating the steel sheet in the non-oxidizing furnace, the steel sheet is oxidized and oxide films are formed thereon. The thickness of the oxide films is 2,000 Å and the rate of formation of the oxide films is 100 Å/sec.

After this, by the same process as in Example 1, heating to 850° C. in the oxidizing furnace, reductions hot-dip galvanizing, and adjustment of coating weight bed air wiping are performed to obtain a hot-dip galvanized steel sheet (No. 7).

In this regard, the rate of formation of oxide films in the oxidizing furnace is 180 Å/sec and the thickness of the oxide films formed by the oxidization is 1,800 Å.

The sum of the thickness of the oxide films formed in the non-oxidizing furnace and the thickness of the oxide films formed in the oxidizing furnace is 3,800 Å. From the viewpoint of improvement in galvanizing characteristics by the oxidization/reduction method, the sum of the thicknesses is important. The rate of formation of oxide films in the non-oxidizing furnace and oxidizing furnace is 130 Å/sec. From the viewpoint of preventing the oxide films from peeling due to contacting with a roller, the rate of formation of oxide films in the non-oxidizing furnace and oxidizing furnace has an effect on the peeling of the oxide films. However, since a problem is caused when the oxide films are relatively thick, the rate of formation of the oxide films in the oxidizing furnace is more important.

(Results)

With regard to the hot-dip galvanized steel sheet thus obtained, characteristics of galvanization were examined The results are shown in Table 1.

In the cases of Sample Nose 1 to 4, the rates of formation of oxide films are from 560 Å/sec to 850 Å/sec, and the formed oxide films are thick, their thicknesses being from 5,600 Å to 8,500 Å. Thus, galvanized steel sheets having good galvanized appearance were obtained.

In the case of Sample No. 5, the rate of formation of oxide films is 180 Å/sec which is lower than 200 Å/sec. Further, the formed oxide films are as thin as 1,800 Å. Accordingly, bare spots were caused to occur and a favorably galvanized steel sheet was not obtained.

In the case of Sample No. 6 the rate of formation of oxide films is 50 Å/sec, which is lower than 200 Å/sec Further, the oxide films thus formed are as thin as 500 Å. Accordingly bare spots were caused to occur and a favorably galvanized steel sheet was not obtained.

In the case of Sample No. 7, the rate of formation of oxide films in the oxidizing furnace is 130 Å/sec, which is lower than 200 Å/sec. Further, the formed oxide films are as thin as 3,800 Å. Accordingly, bare spots were caused to occur and a favorably galvanized steel sheet was not obtained.

TABLE 1

| No. | Contained Si (%) | Pre-oxidization | Oxidizing atmosphere: Combustion air ratio | Flame | Oxygen | Steam | Sheet temp at entrance | Sheet temp at exit | Reducing atmosphere: Sheet temp | Hydrogen | Oxide-film growth rate (Å/s) | Oxide-film thickness (Å) | Galvanized appearance | Category |
|---|---|---|---|---|---|---|---|---|---|---|---|---|---|---|
| 1 | 1.8 | x | 1.2 | Direct | Absent | Absent | 700 | 850 | 850 | 15% | 560 | 5600 | Good | Example |
| 2 | 1.8 | x | 1.2 | Direct | Absent | Present | 700 | 850 | 850 | 15% | 770 | 7700 | Good | Example |
| 3 | 1.8 | x | 1.2 | Direct | Present | Absent | 700 | 850 | 850 | 15% | 620 | 6200 | Good | Example |
| 4 | 1.8 | x | 1.2 | Direct | Present | Present | 700 | 850 | 850 | 15% | 850 | 8500 | Good | Example |
| 5 | 1.8 | x | 1.2 | Direct | Present | Present | 600 | 750 | 750 | 15% | 180 | 1800 | Bare spots | Comparative example |
| 6 | 1.8 | x | 1.2 | — | Present | Present | 700 | 850 | 850 | 15% | 50 | 500 | Bare spots | Comparative Example |
| 7 | 1.8 | ○ | 1.2 | Direct | Present | Present | 700 | 850 | 850 | 15% | 130 | 3800 | Bare spots | Comparative Example |

(Note)
Temperature unit of sheet temperature, etc . . . ° C.

Working Examples 2

Working examples 2 mainly correspond to the second embodiment.

A steel sheet sample was fed into a vertical combustion furnace comprising a preheating chamber, a combustion chamber (NOF chamber), a direct-heating chamber (oxidizing-furnace chamber), and a cooling chamber, and the sample was heated and oxidized. The NOF chamber employs a heating system wherein heat is applied in the lateral direction of the steel sheet by direct-flaming burners. The oxidizing-furnace chamber is the one employing a direct heating system by using slit burners from the upper and lower surfaces of the steel sheet in its vertical direction. COG/Air was used as a combustion gas. The steel sheet sample was cooled by spraying an $N_2$ gas onto it in a cooling zone. A thermocouple was attached to the sample and the temperature of the steel sheet was measured during the heating and cooling treatment. The size of the sample was 210 mm×300 mm. After being heated and oxidized, the steel sheet sample was cooled and taken out. It was then divided into pieces of the size of 210 mm×100 mm, placed in a hot-dip galvanizing simulator, and each piece was heated, reduced, and galvanized. Further, some of the samples were subjected to alloying treatment. Reduction was conducted in an atmosphere of $N_2$-15% $H_2$. Further, the steel sheet is fed into a bath tub containing Zn-0.16% Al during the preparation of a hot-dip galvanized steel sheet and Zn-0.13% Al during the preparation of an alloyed hot-dip galvanized steel sheet. The bath temperature for either case was 460° C.

With the use of the above apparatus and a steel sheet containing silicon for a basis steel sheet, oxidation, reduction, and galvanizing tests were conducted. During the oxidation, the excess air ratio of the NOF chamber and the temperature of the steel sheet were changed according to various conditions. Further, under those NOF conditions, the oxidation conditions were changed to various temperatures within a range in which the steel-sheet temperature was less than 950° C. in the oxidizing chamber to prepare an oxidized sample. The excess air ratio in the oxidizing furnace chamber was 1.10. On the other hand, samples which were not to be oxidized in the oxidizing chamber were also prepared. The samples thus prepared were placed in a hot-dip galvanizing simulator, reduced (in a constant state) in an atmosphere of $N_2$-15% $H_2$ at 850° C. for 60 seconds, and galvanized. Then the degree of defective galvanization in each sample was visually rated.

Further, with respect to each NOF condition, the preventive state for defective galvanization was evaluated according to the following criteria.

○: No defective galvanization at any of the steel-sheet temperatures in the oxidizing furnace Δ: Defective galvanization reduced at some of the steel-sheet temperatures in the oxidizing furnace (Percentage of defectively galvanized area≦3%)

X: a Defective galvanization prominent at all of the steel-sheet temperatures in the oxidizing furnace (Percentage of defectively galvanized area>3%)

The results are shown altogether in Table 2.

TABLE 2

| No. | Basis sheet Si W % | Type of galvanization | NOF chamber Excess Air ratio r1 | NOF chamber Steel-sheet temperature t | 1000 × r1 + 1750 | Oxidizing-furnace chamber presence/absence | Defective galvanization | Remarks |
|---|---|---|---|---|---|---|---|---|
| 1 | 1.00 | GI | 0.95 | 650 | 800 | No heating | x | Comparative example |
| 2 | 1.00 | GI | 1.00 | 650 | 750 | No heating | x | Comparative example |
| 3 | 1.00 | GI | 1.10 | 650 | 650 | No heating | x | Comparative example |
| 4 | 1.00 | GI | 1.10 | 750 | 650 | No heating | x | Comparative example |
| 5 | 1.00 | GI | 1.10 | 850 | 650 | No heating | x | Comparative example |
| 6 | 1.00 | GI | 1.10 | 900 | 650 | No heating | x | Comparative example |
| 7 | 1.00 | GI | 1.10 | 550 | 650 | Heating | x | Comparative example |
| 8 | 1.00 | GI | 1.00 | 450 | 750 | Heating | Δ | Comparative example |
| 9 | 1.00 | GI | 1.00 | 550 | 750 | Heating | Δ | Comparative example |

TABLE 2-continued

| No. | Basis sheet Si W % | Type of galvanization | NOF chamber Excess Air ratio r1 | NOF chamber Steel-sheet temperature t | 1000 × r1 + 1750 | Oxidizing-furnace chamber presence/absence | Defective galvanization | Remarks |
|---|---|---|---|---|---|---|---|---|
| 10 | 1.00 | GI | 1.00 | 650 | 750 | Heating | Δ | Comparative example |
| 11 | 1.00 | GI | 1.00 | 750 | 750 | Heating | x | Comparative example |
| 12 | 1.00 | GI | 0.98 | 400 | 770 | Heating | x | Comparative example |
| 13 | 1.00 | GI | 0.98 | 450 | 770 | Heating | ○ | Example |
| 14 | 1.00 | GI | 0.98 | 650 | 770 | Heating | ○ | Example |
| 15 | 1.00 | GI | 0.98 | 750 | 770 | Heating | ○ | Example |
| 16 | 1.00 | GI | 0.98 | 800 | 770 | Heating | x | Comparative example |
| 17 | 1.00 | GI | 0.95 | 400 | 800 | Heating | x | Comparative example |
| 18 | 1.00 | GI | 0.95 | 450 | 800 | Heating | ○ | Comparative example |
| 19 | 1.00 | GI | 0.95 | 550 | 800 | Heating | ○ | Example |
| 20 | 1.00 | GI | 0.95 | 650 | 800 | Heating | ○ | Example |
| 21 | 1.00 | GI | 0.95 | 750 | 800 | Heating | ○ | Example |
| 22 | 1.00 | GI | 0.95 | 800 | 800 | Heating | ○ | Example |
| 23 | 1.00 | GI | 0.95 | 850 | 800 | Heating | x | Comparative example |
| 24 | 1.00 | GI | 0.90 | 450 | 850 | Heating | ○ | Example |
| 25 | 1.00 | GI | 0.90 | 650 | 850 | Heating | ○ | Example |
| 26 | 1.00 | GI | 0.90 | 750 | 850 | Heating | ○ | Example |
| 27 | 1.00 | GI | 0.90 | 800 | 850 | Heating | ○ | Example |
| 28 | 1.00 | GI | 0.90 | 850 | 850 | Heating | ○ | Example |
| 29 | 1.00 | GI | 0.88 | 650 | 870 | Heating | x | Comparative example |
| 30 | 1.00 | GI | 0.85 | 650 | 900 | Heating | x | Comparative example |
| 31 | 1.00 | GI | 0.85 | 800 | 900 | Heating | Δ | Comparative example |
| 32 | 1.00 | GA | 0.95 | 650 | 800 | Heating | ○ | Example |
| 33 | 1.00 | GA | 0.98 | 650 | 770 | Heating | ○ | Example |
| 34 | 1.00 | GA | 0.95 | 550 | 800 | Heating | ○ | Example |
| 35 | 3.00 | GI | 0.95 | 650 | 800 | Heating | ○ | Example |
| 36 | 0.20 | GI | 0.95 | 650 | 800 | Heating | ○ | Example |

As apparent from Table 2, according to the present invention, a galvanized steel sheet free from defective galvanization can easily be manufactured. Further, by monitoring the temperature of steel sheets before and after the oxidizing furnace, an optimum manufacturing condition can be set.

INDUSTRIAL APPLICABILITY

According to the process for galvanization of the present invention, when a steel sheet containing elements liable to oxidize more easily than iron is oxidized and reduced by the oxidization/reduction method and then galvanized, thick oxide films can be formed without lengthening the oxidizing furnace and reducing the line speed in the step of oxidization by the oxidization/reduction method. Therefore, the steel sheet containing elements which are liable to oxidize more easily than iron can preferably be used as a basis material to produce a galvanized steel sheet or alloyed hot-dip galvanized steel sheet free from defective galvanization. In particular, the above process is useful if a steel sheet containing silicon of 1.2 mass percent or more is used as a basis material, and it is more useful if a steel sheet containing silicon of 1.8 mass percent or more is used.

Having described our invention as related to the embodiments shown in the accompanying drawings, it is obvious to those skilled in the art that modification and variation of our invention can be made. Therefore, it is to be understood that all such modification and variation fall within the spirit and scope of our invention.

The invention claimed is:

1. A process for hot-dip galvanization in which a steel sheet is treated by oxidization/reduction for better quality of galvanization and then galvanized, wherein an annealing line of hot-dip galvanizing equipment is composed of a first non-oxidizing zone, a second oxidizing zone, and a third reducing zone arranged in an order of first to third zone in line;

wherein a steel sheet containing silicon of 0.2-3.0 weight percent is oxidized during oxidization/reduction by flames blown to it in the oxidizing zone and then reduced and annealed in the reducing zone, characterized in that said steel sheet on which rolling oil sticks is heated under conditions where the excess air ratio $r_1$ is 0.9 or higher but below 1.00, the temperature t (° C.) of the steel sheet is 450° C. or higher, and said excess air ratio $r_1$ and temperature t (° C.) of the steel sheet satisfy the expression: $t \leqq -1000 \times r_1 + 1750$ in said non-oxidizing zone; and said steel sheet is then heated by flames which are directly applied for direct heating by burners whose nozzles are directed toward the upper and lower surfaces of said steel sheet and extend in the lateral direction of said steel sheet, under a condition where an air-fuel ratio $r_2$ is 1.00 or higher in said oxidizing zone.

2. A process for hot-dip galvanization according to claim 1, wherein said air-fuel ratio $r_2$ in said oxidizing zone is between 1.00 and 1.25.

3. A process for hot-dip galvanization in which a steel sheet containing silicon of not less than 0.2 weight percent is treated by oxidization/reduction for better quality of galvanization and then galvanized, wherein the steel sheet is heated to 600° C. or higher and then is oxidized with flames blown onto it during oxidization/reduction, the steel sheet is passed through an oxidizing zone of the blown flames, and oxide films are formed on surfaces of the steel sheet at a rate of 200-2,000 Å/sec.

4. A process for hot-dip galvanization according to claim 3, wherein burners are used to blow said flames onto the steel sheet and oxygen equivalent to 0-20 volume percent of combustion air and/or steam equivalent to 0-40 volume percent of combustion air are mixed into the combustion air of the burners.

5. The process for hot-dip galvanization according to claim 3, wherein oxidation/reduction occurs in an annealing line of hot-dip galvanizing equipment composed of a first non-oxidizing zone, a second oxidizing zone, and a third reducing zone arranged in an order of first to third zone in line, and said oxidation is performed in said oxidizing zone.

* * * * *